US011231004B2

(12) United States Patent
Campton et al.

(10) Patent No.: US 11,231,004 B2
(45) Date of Patent: Jan. 25, 2022

(54) PERMANENTLY ENGAGED STARTER SYSTEM

(71) Applicant: BorgWarner Inc., Auburn Hills, MI (US)

(72) Inventors: Calahan B. Campton, Royal Oak, MI (US); James R. Papania, Frankfort, IL (US); Michael W. Campbell, Royal Oak, MI (US)

(73) Assignee: Borg Warner Inc., Auburn Hills, MI (US)

( * ) Notice: Subject to any disclaimer, the term of this patent is extended or adjusted under 35 U.S.C. 154(b) by 0 days.

(21) Appl. No.: 17/332,551

(22) Filed: May 27, 2021

(65) Prior Publication Data

US 2021/0372354 A1 Dec. 2, 2021

Related U.S. Application Data

(60) Provisional application No. 63/032,713, filed on May 31, 2020.

(51) Int. Cl.
*F01N 11/00* (2006.01)
*F02N 11/00* (2006.01)

(52) U.S. Cl.
CPC ..... *F02N 11/00* (2013.01)

(58) Field of Classification Search
CPC ..... F02N 11/00; F02N 11/0803; F02N 11/08
See application file for complete search history.

(56) References Cited

U.S. PATENT DOCUMENTS 4,180,743 A * 12/1979 Lacroix ..... F02N 11/00 290/38 B
4,233,521 A * 11/1980 Pouget ..... F02N 5/04 290/38 B (Continued)

FOREIGN PATENT DOCUMENTS

DE 102015008895 A1 1/2017
DE 102015014029 A1 5/2017

OTHER PUBLICATIONS

Machine-assisted English language abstract and machine-assisted English translation for DE 10 2015 008 895 A1 extracted from espacenet.com database on Jun. 9, 2021, 22 pages.

(Continued)

*Primary Examiner* — David M Fenstermacher
(74) *Attorney, Agent, or Firm* — Howard & Howard Attorneys PLLC

(57) ABSTRACT

A permanently engaged starter system for use in a vehicle includes a dual-mass flywheel. The vehicle includes a crankshaft, an engine block, and a transmission. The dual-mass flywheel includes an engine side primary mass, a transmission side primary mass rotatably coupled to the engine side primary mass, and a secondary mass rotatably coupled to the transmission side primary mass. The permanently engaged starter system also includes a one-way clutch including an inner race disposed about the axis. The permanently engages starter system additionally includes a ring gear rotatably coupled to the inner race of the one-way clutch. The transmission side primary mass or the secondary mass of the dual-mass flywheel is configured to be an outer race for the one-way clutch.

21 Claims, 1 Drawing Sheet

(56) References Cited

U.S. PATENT DOCUMENTS

| | | | | |
|---|---|---|---|---|
| 5,610,466 | A * | 3/1997 | Shiga | F02N 11/00 310/239 |
| 5,898,229 | A * | 4/1999 | Murata | F02N 15/023 290/48 |
| 8,651,080 | B2 * | 2/2014 | Sugimura | F02N 15/023 123/179.25 |
| 9,803,611 | B2 | 10/2017 | Showalter | |
| 10,018,230 | B2 | 7/2018 | Peglowski | |
| 10,274,026 | B2 | 4/2019 | Veit et al. | |
| 10,619,701 | B2 | 4/2020 | Maguire et al. | |
| 2006/0112923 | A1 * | 6/2006 | Zimmerman | F02N 11/00 123/179.25 |
| 2011/0048358 | A1 * | 3/2011 | Gaborel | F16D 41/07 123/179.25 |
| 2013/0061716 | A1 * | 3/2013 | Kamimura | B23K 26/28 74/7 E |
| 2014/0026689 | A1 * | 1/2014 | Nakamura | F02N 11/00 74/6 |
| 2014/0260795 | A1 * | 9/2014 | Gray | F02N 11/0851 74/7 E |
| 2015/0159616 | A1 * | 6/2015 | Milliren | F02N 15/025 74/7 A |
| 2017/0058852 | A1 * | 3/2017 | Takagi | F02N 11/02 |
| 2017/0122386 | A1 | 5/2017 | Veit et al. | |
| 2017/0241491 | A1 * | 8/2017 | Peglowski | F02N 11/00 |
| 2017/0338706 | A1 * | 11/2017 | Hao | F02N 11/04 |

OTHER PUBLICATIONS

English language abstract for DE 10 2015 014 029 A1 extracted from espacenet.com database on Jun. 9, 2021, 2 pages.
U.S. Appl. No. 17/332,516, filed May 27, 2021.
U.S. Appl. No. 17/388,239, filed Jul. 29, 2021.

* cited by examiner

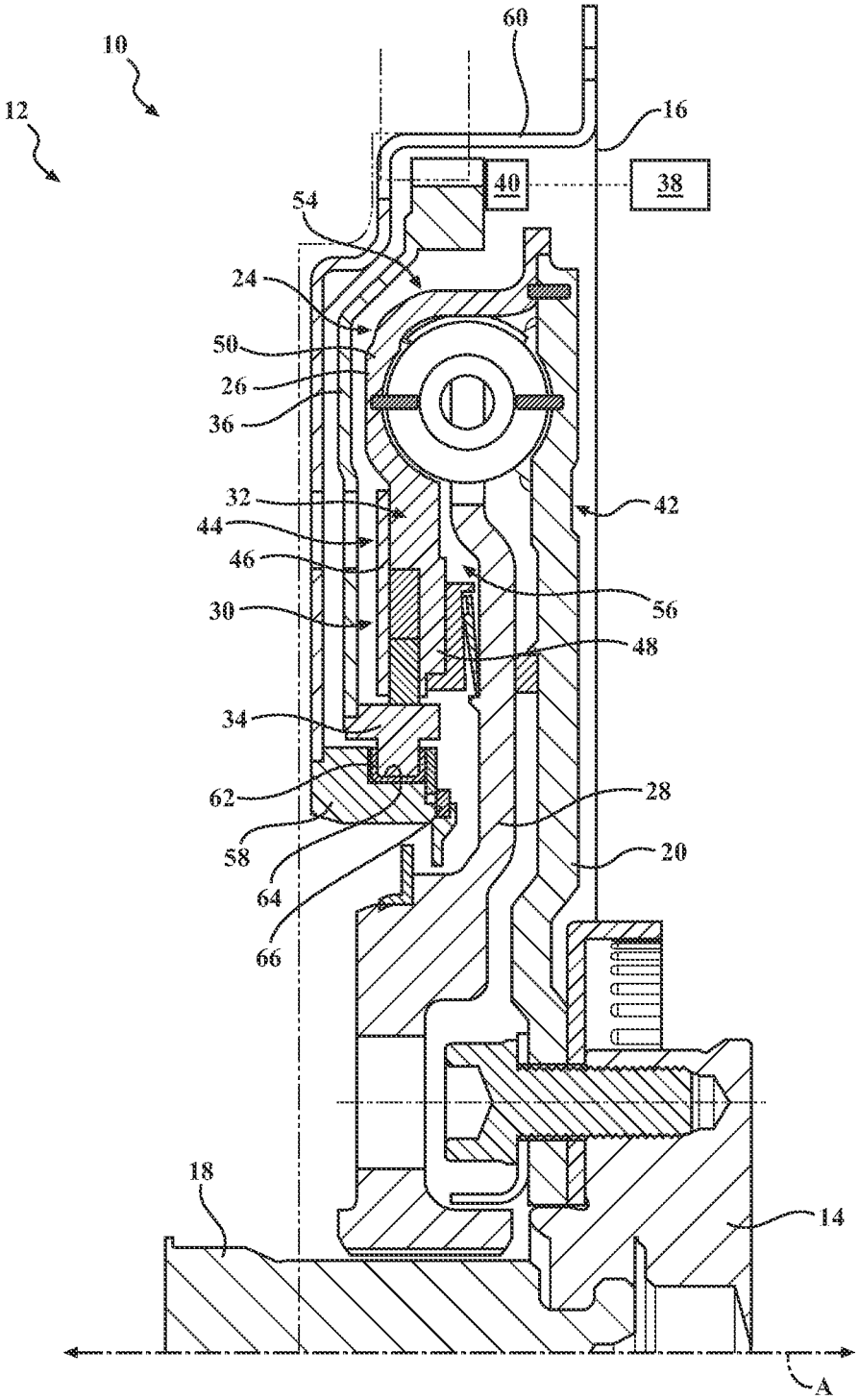
10
12
60
16
40
38
54
24
50
26
36
32
44
46
30
34
62
58
64
66
42
56
48
28
20
18
14
A

PERMANENTLY ENGAGED STARTER SYSTEM

CROSS-REFERENCE TO RELATED APPLICATIONS

The present application claims priority to and all the benefits of U.S. Provisional Application No. 63/032,713 filed on May 31, 2020, the disclosure of which is incorporated by reference in its entirety.

BACKGROUND OF THE INVENTION

1. Field of the Invention

The present invention generally relates to a permanently engaged starter system and, more specifically, to a permanently engaged starter system for use in a vehicle.

2. Description of the Related Art

Conventional permanently engaged starter systems include an engine side primary mass rotatably coupled to a crankshaft of a vehicle, a clutch rotatably coupled to the engine side primary mass, a ring gear rotatably coupled to the clutch, and a starter motor including a pinion gear rotatably coupled to the ring gear for providing rotational torque to the crankshaft through the clutch and the engine side primary mass. However, conventional permanently engaged starter systems are often costly, occupy substantial space in an engine bay, and are limited in their configurations and orientations within the engine bay.

As such, there remains a need to provide an improved permanently engaged starter system.

SUMMARY OF THE INVENTION AND ADVANTAGES

A permanently engaged starter system for use in a vehicle includes a dual-mass flywheel. The vehicle includes a crankshaft, an engine block, and a transmission. The dual-mass flywheel includes an engine side primary mass extending along and rotatable about an axis with the engine side primary mass being adapted to be rotatably coupled to the crankshaft, a transmission side primary mass disposed about the axis and rotatably coupled to the engine side primary mass, and a secondary mass disposed about the axis rotatably coupled to the transmission side primary mass and adapted to be rotatably coupled to the transmission. The permanently engaged starter system also includes a one-way clutch including an inner race disposed about the axis. The permanently engages starter system additionally includes a ring gear rotatably coupled to the inner race of the one-way clutch. The transmission side primary mass or the secondary mass of the dual-mass flywheel is configured to be an outer race for the one-way clutch.

Having the transmission side primary mass or the secondary mass of the dual-mass flywheel being configured to be an outer race for the one-way clutch reduces packaging space and, in particular, axial packaging. Additionally, the one-way clutch is supported by the dual-mass flywheel when the transmission side primary mass or the secondary mass are configured to be the outer race for the one-way clutch, which increases the strength of the one-way clutch. Furthermore, having the transmission side primary mass or the secondary mass of the dual-mass flywheel configured to be an outer race for the one-way clutch allows the possibility to remove rivets to secure components of the permanently engaged starter system, which eliminates a leak path for grease out of the dual-mass flywheel.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a cross-sectional view of a permanently engaged starter system including a dual-mass flywheel, a one-way clutch, and a ring gear.

DETAILED DESCRIPTION OF THE INVENTION

With reference to the FIGURES, wherein like numerals indicate like parts throughout the several views, a permanently engaged starter system 10 for use in a vehicle 12 is shown in cross-sectional view. The vehicle 12 includes a crankshaft 14, an engine block 16 of an internal combustion engine, and a transmission 18. The permanently engaged starter system 10 also includes a dual-mass flywheel 24 including an engine side primary mass 20 extending along and rotatable about an axis A with the engine side primary mass 20 being adapted to be rotatably coupled to the crankshaft 14, a transmission side primary mass 26 disposed about the axis A and rotatably coupled to the engine side primary mass 20, and a secondary mass 28 disposed about the axis A rotatably coupled to the transmission side primary mass 26 and adapted to be rotatably coupled to the transmission 18. It is to be appreciated that the secondary mass 28 may also be adapted to be rotatably coupled to a torque converter. The permanently engaged starter system 10 further includes a one-way clutch 30 including an inner race 34 disposed about the axis A. The one-way clutch 30 may be press-fit into the transmission side primary mass of the dual-mass flywheel 24. The permanently engaged starter system 10 also includes a ring gear 36 rotatably coupled to the inner race 34 of the one-way clutch 30. Although not required, the permanently engaged starter system 10 may include a starter motor 38 including a pinion gear 40 rotatably coupled to the ring gear 36 for providing rotational torque to the crankshaft 14 through the inner race 34, the transmission side primary mass 26 of the dual-mass flywheel 24, and the engine side primary mass 20. The pinion gear 40 is typically permanently engaged with the ring gear 30, resulting in a permanently engaged starter system.

The transmission side primary mass 26 or the secondary mass 28 of the dual-mass flywheel 24 are configured to be an outer race 34 for the one-way clutch 30. In other words, at least one of the transmission side primary mass 26 and the secondary mass 28 of the dual-mass flywheel 24 are configured to be the outer race 34 for the one-way clutch 30. Having the transmission side primary mass 26 or the secondary mass 28 of the dual-mass flywheel 24 configured to be the outer race 34 for the one-way clutch 30 reduces packaging space and, in particular, axial packaging as the permanently engaged starter system 10 occupies less space than when one of the transmission side primary mass 26 and the secondary mass 28 are not configured to be the outer race 34 for the one-way clutch 30. Additionally, as described in further detail below, the one-way clutch 30 is supported by the dual-mass flywheel 24 when the transmission side primary mass 26 or the secondary mass 28 are configured to be the outer race 34 for the one-way clutch, which increases the strength of the one-way clutch 30 because the one-way clutch 30 is supported by a more rigid component (the transmission side primary mass 26 or the secondary mass 28 of the dual-mass flywheel 24). Furthermore, having the transmission side primary mass 26 or the secondary mass 28 of the dual-mass flywheel 24 configured to be the outer race 34 for the one-way clutch 30 allows the possibility to remove rivets to secure components of the permanently engaged starter system 10, which would eliminate a leak path for grease out of the dual-mass flywheel 24. Also, having the transmission side primary mass 26 or the secondary mass 28 of the dual-mass flywheel 24 configured to be the outer race 34 for the one-way clutch 30, the permanently engaged starter system 10 may be fixedly coupled to the engine block 16 without the use of fasteners, such as welding or a cutting spline. By fixedly coupling the permanently engaged starter system 10 to the engine block 16 without the use of fasteners, potential leak paths for grease to leave the dual-mass flywheel 24 are eliminated. In one embodiment, the transmission side primary mass 26 of the dual-mass flywheel 24 is configured to be the outer race 34 for the one-way clutch 30. In another embodiment, the secondary mass 28 of the dual-mass flywheel 24 is configured to be the outer race 34 for the one-way clutch 30.

The one-way clutch 30 may be 30 is nested within the dual-mass flywheel 24 with respect to the axis A. Having the one-way clutch 30 nested within the dual-mass flywheel 24 with respect to the axis A reduces packaging space and, in particular, axial packaging as the permanently engaged starter system 10 occupies less space than when the one-way clutch 30 is not nested within the dual-mass flywheel 24. In one embodiment, the one-way clutch 30 is nested within the transmission side primary mass 26 of the dual-mass flywheel 24 with respect to the axis A. Having the one-way clutch 30 nested within the transmission side primary mass 26 of the dual-mass flywheel 24 with respect to the axis reduces packaging space and, in particular, axial packaging as the permanently engaged starter system 10 occupies less space than when the one-way clutch 30 is not nested within the transmission side primary mass 26. Additionally, the one-way clutch 30 may supported by the transmission side primary mass 26 when the one-way clutch 30 is nested within the transmission side primary mass 26 with respect to the axis A, which increases the strength of the one-way clutch 30 because the one-way clutch 30 is supported by a more rigid component (the transmission side primary mass 26 is thicker than typical races and/or side plates of a one-way clutch).

The transmission side primary mass 26 has an engine side 42 adapted to face the internal combustion engine, and a transmission side 44 adapted to face the transmission 18. In one embodiment, as shown in FIG. 1, the one-way clutch 30 is disposed on the transmission side 44 of the transmission side primary mass 26. It is to be appreciated that in other embodiments the one-way clutch 30 may be disposed on the engine side 42 of the transmission side primary mass 26.

The one-way clutch 30 may have a side plate 46, and the transmission side primary mass 26 of the dual-mass flywheel 24 may have a primary arm 48 extending toward the axis A such that the primary arm 48 is configured to be a side plate of the one-way clutch 30. In such embodiments, the side plate 46 and the primary arm 48 are coupled to the inner race 34 of the one-way clutch 30. The transmission side primary mass 26 may have a primary body 50, and the primary arm 48 may be integral, i.e., one-piece, with the primary body 50. To secure the transmission side primary mass 26 to the one-way clutch 30, the permanently engaged starter system 10 may include a fastener, such as a bolt, extending through the primary arm 48 of the transmission side primary mass 26 and the side plate 46 for securing the transmission side primary mass 26 to the one-way clutch 30. It is to be appreciated that the transmission side primary mass 26 may be secured to the one-way clutch 30 through other suitable ways, such as through welding, which would further reduce the need for fasteners.

The transmission side primary mass 26 of the dual-mass flywheel 24 may have a first primary end 54 radially spaced from the axis A, and a second primary end 56 radially spaced from the axis A and adjacent the one-way clutch 30 such that the second primary end 56 is disposed between the first primary end 54 and the axis A. In such embodiments, the one-way clutch 30 may be disposed between the first primary end 54 and the axis A such that the one-way clutch 30 is axially and radially retained within the transmission side primary mass 26 of the dual-mass flywheel 24. In such embodiments, the first primary end 54 essentially acts as an extended support for the one-way clutch 30 because the one-way clutch 30 is retained within the transmission side primary mass 26 with respect to the axis A and provides additional support and rigidity during rotation of the one-way clutch 30.

The transmission side primary mass 26 of the dual-mass flywheel 24 may be configured to radially support the one-way clutch 30 during rotation of the transmission side primary mass 26. In such embodiments, the transmission side primary mass 26 provides additional radial support to the one-way clutch 30.

The permanently engaged starter system 10 may include a pilot support plate 58 coupled to the one-way clutch 30, and a starter support plate 60 coupled to the pilot support plate 58. When present, the starter support plate 60 is adapted to be coupled to the engine block 16. The pilot support plate 58 and the starter support plate 60 removes the need for fasteners to couple the pilot support plate 58 directly to the engine block 16, which further reduces axial packaging and dimensional stack up as components of the permanently engaged starter system 10 are able to be placed closer together.

Typically, the pilot support plate 58 is coupled to the inner race 34 of the one-way clutch 30. When the pilot support plate 58 is coupled to the inner race 34 of the one-way clutch 30, the pilot support plate 58 is typically configured to axially and radially align and retain the ring gear 36 and the one-way clutch 30 with respect to the axis A.

The permanently engaged starter system 10 may include a bushing 62 coupled to the pilot support plate 58, with the bushing 62 rotatably supporting the ring gear 36 and the inner race 34 of the one-way clutch 30 as the ring gear 36 rotates about the axis with respect to the pilot support plate 58. The bushing 62 may define a bushing channel 64, with the bushing channel 64 receiving the inner race 34 of the one-way clutch 30. To also help with axially and radially align and retain the ring gear 36 and the one-way clutch 30 with respect to the axis A, the permanently engaged starter system 10 may include a snap ring 66 coupled to the pilot support plate 58 for axially retaining the one-way clutch 30 with respect to the axis A.

The one-way clutch 30 may be nested within the starter support plate 60 with respect to the axis A. In one embodiment, the one-way clutch is nested radially within the starter support plate 60 with respect to the axis A. The dual-mass flywheel 24 may be nested within the starter support plate 60 with respect to the axis A. In one embodiment, the dual-mass flywheel 24 is nested radially within the starter support plate 60 with respect to the axis A. The one-way clutch 30 may be disposed between the starter support plate 60 and the dual-mass flywheel 24 with respect to the axis A.

In one embodiment, the dual-mass flywheel 24 of the permanently engaged starter system 10 includes the engine side primary mass 20 extending along and rotatable about the axis A with the engine side primary mass 20 being adapted to be rotatably coupled to the crankshaft 14, the transmission side primary mass 26 disposed about the axis A and rotatably coupled to the engine side primary mass 20, and the secondary mass 28 disposed about the axis A and rotatably coupled to the transmission side primary mass 26 and adapted to be rotatably coupled to the transmission 18. In such embodiments, the one-way clutch 30 includes the outer race 32 disposed about the axis A, the ring gear 36 rotatably coupled to the outer race 32 of the one-way clutch 30, and the starter motor 38 comprising the pinion gear 40 rotatably coupled to the ring gear 36 for providing rotational torque to the crankshaft 14 through the one-way clutch 30 and the dual-mass flywheel 24. The transmission side primary mass 26 or the secondary mass 28 of the dual-mass flywheel 24 is configured to be an inner race 34 for the one-way clutch 30. In other words, although FIG. 1 shows the transmission side primary mass 26 configured to be an outer race 32 for the one-way clutch 30, it is contemplated that the transmission side primary mass 26 or the secondary mass 28 may be configured to be an inner race 34 for the one-way clutch 30. To this end, it is to be appreciated that the description and examples above may equally apply to embodiments where the transmission side primary mass 26 or the secondary mass 28 is configured as an inner race 34 for the one-way clutch 30. In one embodiment, the transmission side primary mass 26 is configured to be an inner race 34 for the one-way clutch 30. In another embodiment, the secondary mass 28 is configured to be an inner race 34 for the one-way clutch 30.

In embodiments where the one-way clutch 30 is be nested within the starter support plate 60 with respect to the axis A, the dual-mass flywheel 24 is nested within the starter support plate 60 with respect to the axis A, and/or the one-way clutch 30 is disposed between the starter support plate 60 and the dual-mass flywheel 24 with respect to the axis A reduces axial packaging and dimensional stack up as components of the permanently engaged starter system 10 are able to be placed closer together.

What is claimed is:

1. A permanently engaged starter system for use in a vehicle including a crankshaft, an engine block, and a transmission, said permanently engaged starter system comprising:

a dual-mass flywheel comprising an engine side primary mass extending along and rotatable about an axis with said engine side primary mass being adapted to be rotatably coupled to the crankshaft, a transmission side primary mass disposed about said axis and rotatably coupled to said engine side primary mass, and a secondary mass disposed about said axis rotatably coupled to said transmission side primary mass and adapted to be rotatably coupled to the transmission;

a one-way clutch comprising an inner race disposed about said axis; and a ring gear rotatably coupled to said inner race of said one-way clutch;

wherein said transmission side primary mass or said secondary mass of said dual-mass flywheel is configured to be an outer race for said one-way clutch.

2. The permanently engaged starter system as set forth in claim 1 further comprising a starter motor comprising a pinion gear rotatably coupled to said ring gear for providing rotational torque to the crankshaft through said one-way clutch and said dual-mass flywheel.

3. The permanently engaged starter system as set forth in claim 1, wherein said transmission side primary mass of said dual-mass flywheel is configured to be an outer race for said one-way clutch.

4. The permanently engaged starter system as set forth in claim 1, wherein said transmission side primary mass has an engine side adapted to face the internal combustion engine, and a transmission side adapted to face the transmission, and wherein said one-way clutch is disposed on said transmission side of said transmission side primary mass.

5. The permanently engaged starter system as set forth in claim 1, wherein said one-way clutch is nested within said dual-mass flywheel with respect to said axis.

6. The permanently engaged starter system as set forth in claim 1, wherein said one-way clutch is nested within said transmission side primary mass of said dual-mass flywheel with respect to said axis.

7. The permanently engaged starter system as set forth in claim 1, wherein said one-way clutch has a side plate, wherein said transmission side primary mass of said dual-mass flywheel has a primary arm extending toward said axis such that said primary arm is configured to be a side plate of said one-way clutch, and wherein said side plate and said primary arm are coupled to said inner race of said one-way clutch.

8. The permanently engaged starter system as set forth in claim 1, wherein said transmission side primary mass of said dual-mass flywheel has a first primary end radially spaced from said axis, and a second primary end radially spaced from said axis and adjacent said one-way clutch such that said second primary end is disposed between said first primary end and said axis, and wherein said one-way clutch is disposed between said first primary end and said axis such that said one-way clutch is axially and radially retained within said transmission side primary mass of said dual-mass flywheel.

9. The permanently engaged starter system as set forth in claim 1, wherein said transmission side primary mass of said dual-mass flywheel is configured to radially support said one-way clutch during rotation of said transmission side primary mass.

10. The permanently engaged starter system as set forth in claim 1 further comprising a pilot support plate coupled to said one-way clutch, and a starter support plate coupled to said pilot support plate, wherein said starter support plate is adapted to be coupled to the engine block.

11. The permanently engaged starter system as set forth in claim 10, wherein said pilot support plate is coupled to said inner race of said one-way clutch.

12. The permanently engaged starter system as set forth in claim 10, wherein said pilot support plate is configured to axially and radially align and retain said ring gear and said one-way clutch with respect to said axis.

13. The permanently engaged starter system as set forth in claim 10 further comprising a bushing coupled to said pilot support plate, wherein said bushing rotatably supports said ring gear and said inner race of said one-way clutch as said ring gear rotates about said axis with respect to said pilot support plate.

14. The permanently engaged starter system as set forth in claim 13, wherein said bushing defines a bushing channel, and wherein said bushing channel receives said inner race of said one-way clutch.

15. The permanently engaged starter system as set forth in claim 10 further comprising a snap ring coupled to said pilot support plate for axially retaining said one-way clutch with respect to said axis.

16. The permanently engaged starter system as set forth in claim 10, wherein said one-way clutch is nested within said starter support plate with respect to said axis.

17. The permanently engaged starter system as set forth in statement 10, wherein said dual-mass flywheel is nested within said starter support plate with respect to said axis.

18. The permanently engaged starter system as set forth in claim 10, wherein said one-way clutch is disposed between said starter support plate and said dual-mass flywheel with respect to said axis.

19. The permanently engaged starter system as set forth in claim 1, wherein said one-way clutch is press-fit into said transmission side primary mass of said dual-mass flywheel.

20. The permanently engaged starter system as set forth in claim 1, wherein said secondary mass of said dual-mass flywheel is configured to be an outer race for said one-way clutch.

21. A permanently engaged starter system for use in a vehicle including a crankshaft and an engine block and including a transmission, said permanently engaged starter system comprising:

a dual-mass flywheel comprising an engine side primary mass extending along and rotatable about an axis with said engine side primary mass being adapted to be rotatably coupled to the crankshaft, a transmission side primary mass disposed about said axis and rotatably coupled to said engine side primary mass, and a secondary mass disposed about said axis rotatably coupled to said transmission side primary mass and adapted to be rotatably coupled to the transmission;

a one-way clutch comprising an outer race disposed about said axis; and a ring gear rotatably coupled to said outer race of said one-way clutch;

wherein said transmission side primary mass or said secondary mass of said dual-mass flywheel is configured to be an inner race for said one-way clutch.

* * * * *